United States Patent [19]

Couture

[11] Patent Number: 4,535,943

[45] Date of Patent: Aug. 20, 1985

[54] PULPING APPARATUS INCLUDING A ROTOR AND HELICAL SCREW FLIGHTS EXTENDING UPWARDLY FROM THE ROTOR

[75] Inventor: Joseph W. Couture, Dorval, Canada

[73] Assignee: The Black Clawson Company, Middletown, Ohio

[21] Appl. No.: 644,644

[22] Filed: Aug. 24, 1984

Related U.S. Application Data

[63] Continuation of Ser. No. 495,872, May 18, 1983, abandoned.

[51] Int. Cl.[3] ..... B02C 13/18

[52] U.S. Cl. ..... 241/46.02; 162/261; 241/46.17

[58] Field of Search ..... 162/261; 241/46.02, 241/46.11, 46.17

[56] References Cited

U.S. PATENT DOCUMENTS

| | | | |
|---|---|---|---|
| 3,035,781 | 5/1962 | Wallen | 241/46.17 |
| 3,889,885 | 6/1975 | Couture | 241/46.17 |
| 4,109,872 | 8/1978 | Couture | 241/46.11 |
| 4,347,035 | 8/1982 | Stahle | 241/46.17 |

*Primary Examiner*—Steve Alvo

*Attorney, Agent, or Firm*—Biebel, French & Nauman

[57] ABSTRACT

Pulping apparatus for pulping high consistency paper pulp includes a tub having a bottom wall and a generally cylindrical side wall extending upwardly therefrom, and a rotor mounted centrally of the bottom wall for rotation about a vertical axis and having a hub portion, a plurality of vanes extending generally radially outwardly from the hub and having pumping and defibering faces thereon, and a plurality of helical screw flights extending upwardly from the hub. Each flight has a concave undersurface such that rotation of the rotor in the presence of high consistency pulp causes the screw flights to draw pulp inwardly toward the axis of rotation and push it downwardly to the defibering faces of the vanes, and the outer surface of each flight being convexly curved and of substantially greater surface are than its undersurface to provide an air foil effect further tending to draw pulp into the path of the undersurface of the following flight. The screw flights preferably include trailing portions having raised peripheral ridges extending upwardly therefrom to prevent stock from flowing outwardly from the rotor until it reaches the vicinity of the vanes. The trailing portions of the screw flights preferably have a width, measured in a radial direction, which is substantially the same as the length of the vanes such that pulp can be pushed downwardly and outwardly into the entire path of the working faces of the vanes.

8 Claims, 9 Drawing Figures

PULPING APPARATUS INCLUDING A ROTOR AND HELICAL SCREW FLIGHTS EXTENDING UPWARDLY FROM THE ROTOR

CROSS REFERENCE TO PENDING APPLICATION

This application is a continuation of application Ser. No. 495,872, filed May 18, 1983 and now abandoned.

BACKGROUND OF THE INVENTION

The present invention is directed to apparatus and methods for pulping or defibering paper pulp of high consistency, e.g. between 12% and 25% solids, and more particularly, to pulping apparatus in which a rotor circulates pulp stock within a tub.

Pulping apparatus for defibering waste paper and the like typically include a vat or tub within which is mounted at least one rotor or impeller for circulating the paper stock to be defibered. The rotors presently in use effect defibering of pulp stock by creating mechanical shear and/or hydraulic shear conditions which act on the pulp to reduce its particle size to predetermined maximum dimensions. Mechanical shear is achieved by the interaction of a moving surface, typically on a rotor, with a stationary surface, typically the bottom wall or bed plate above which the rotor is mounted. Hydraulic shear occurs when pulp fibers contact other pulp fibers in the stock as a result of the turbulence or flow pattern generated by the rotor within the tub.

Most pulping devices currently in use are capable of defibering pulp stock up to a maximum consistency of approximately 5% to 8% solids, such as the pulping apparatus disclosed in Couture U.S. Pat. No. 4,109,872, commonly assigned. That patent discloses pulping apparatus having a rotor with a relatively flat body and a plurality of vanes extending generally radially outwardly from the body. Rotation of the rotor creates both hydraulic and mechanical shear in the vicinity of the rotor vanes. However, such pulping devices are incapable of pulping paper stock having a consistency higher than about 10% solids, because stock of that high consistency will not circulate in the tub in response to the rotation of such a rotor.

It is desirable to pulp paper stock having higher consistencies of, for example, between 12% and 25% solids. Not only can a given tub hold a greater volume of pulp for a given batch to be processed, but the hydraulic shear created in the higher density pulp, if it can be circulated properly, defibers the stock at a faster rate than for low density pulp. However, pulping devices of the type previously described are incapable of pulping paper stock at these higher consistencies. Due to the high viscosity of high consistency pulp stock, the rotation of the rotor would displace pulp stock outwardly from the vicinity of the vanes, but the stock immediately above the rotor would not flow downwardly to fill the void, creating a condition of rotor cavitation. With such cavitation conditions, the pulp stock is not circulated, and the desired hydraulic and mechanical shear effects cannot occur.

Rotors have been designed which include means for urging the stock from the center of the tub downwardly into contact with pumping members. For example, Wallen U.S. Pat. No. 3,035,781, discloses a rotor comprising a body having a hyperbolic contour which supports a pair of flat screw flights. Each screw flight is helically shaped and includes a leading edge which is oriented substantially perpendicular to the axis of rotation of the rotor, and a trailing edge which is oriented substantially parallel to the rotational axis. When the rotor is rotated in the presence of pulp stock, the screw flights urge the pulp stock downwardly and cooperate with the hyperbolic body to pump the stock radially outwardly, but this patent does not disclose the consistency of any stock of which it had been used.

A disadvantage with such a rotor is that the screw flight design does not create mechanical shear conditions which would accelerate the defibering of the pulp stock, since the trailing portions of the screw flights do not interact with a stationary object. Furthermore, a substantial portion of the screw flight is inclined relative to the axis of rotation, and as a result would tend to urge pulp stock outwardly from the axis before the pulp stock reached the trailing pumping portions of the flights. Since this outwardly flowing stock would not contact the pumping portions, the hydraulic shear effect upon it would be reduced.

Accordingly, there is a need for a high consistency pulping apparatus which includes a rotor capable of generating both hydraulic and mechanical shear forces. There is also a need for a high consistency pulping device having a rotor which positively guides the pulp stock downwardly to engage the entire working face of the pumping means to maximize hydraulic shear forces.

SUMMARY OF THE INVENTION

The present invention provides a pulping apparatus and method which are capable of defibering pulp stock having a consistency of between 12% and 25% solids in a volume of high consistency pulp stock which is comparable in size to the volumes of low consistency pulp stock, typically between about 5% and 8% solids, which can be defibered by prior art devices. The pulping apparatus of the invention includes a rotor which is designed to create both mechanical and hydraulic shear forces, thereby maximizing the rate of which the high consistency pulp stock is defibered. Another advantage of the present invention is that a greater portion of the high consistency pulp in the center of the tub is urged downwardly into contact with the pumping faces of the vanes than with prior art devices, thus generating higher levels of hydraulic shear as a greater amount of pulp is circulated outwardly against the walls of the tub.

The present invention provides apparatus for pulping high consistency paper stock including a tub having a bottom wall with a screen portion for removing accepts-rich stock from the tub and a generally cylindrical side wall extending upwardly from the bottom wall, and a rotor mounted centrally of the bottom wall for rotation about a vertical axis and including a base portion, a plurality of vanes extending radially outwardly from the base portion, and a plurality of helical screw flights extending upwardly from the base portion.

Each of the screw flights includes a concave undersurface so that rotation of the rotor causes the concave undersurfaces of the flights to draw stock inwardly toward the axis of rotation, and the helical shape of the flights pushes the stock downwardly toward the defibering faces of the vanes. In addition, each screw flight includes a convex outer surface which is of substantially greater area than its undersurface to act like an air foil in developing suction which draws pulp into the path of the concave surface of the following flight.

To ensure that pulp is distributed over the entire area of the defibering faces of the vanes, each of the helical screw flights includes a trailing portion which terminates at the base of the rotor and has a width in a radial direction which is substantially equal to the radial dimension of the vanes. Pulp which is pushed downwardly by the screw flights is deposited adjacent the base of the rotor and, as a result of the matching widths of the trailing portions of the screw and the defibering faces of the vanes, is spread over the entire surface of defibering faces of the vanes.

Any tendency of pulp pushed downwardly by the rotating screw flights to disperse outwardly away from the rotor prior to encountering the defibering faces of the vanes is counteracted by providing the trailing portion of each vane flight with a raised peripheral ridge extending upwardly therefrom which forms a generally trough-shaped conduit with the trailing portion. These ridges guide pulp passing over the upper surfaces of the screw flights downwardly toward the defibering faces of the vanes and prevent it from dispersing outwardly once it has been drawn inwardly by the concave undersides of the screw flights.

Preferably, the trailing portion of each screw flight intersects one of the rotor vanes such that the terminal edge of each screw flight coincides with the trailing edge of a vane. This arrangement of screw flights and vanes provides a gap between vanes which exposes the bottom wall of the tub directly beneath the rotor vanes. By spacing the rotor slightly above the bottom wall, mechanical shear conditions can be created between the vane faces and the bottom wall of the tub.

In a preferred embodiment of the invention, the hub portion of the rotor is generally frustoconical, but with curved rather than straight sides, and the core of the feed screw forms a continuation of this conical hub to provide a downwardly and outwardly flaring surface which cooperates with the trailing portions of the screw flights to guide pulp outwardly into the paths of the defibering faces of the vanes.

Accordingly, it is an object of the present invention to provide an apparatus for pulping high consistency paper stock efficiently and economically; an apparatus for pulping high consistency paper stock which includes means for drawing pulp stock inwardly and downwardly where the stock can encounter the entire surface of the defibering faces of the vane and thereby minimize the likelihood of cavitation; and a pulping apparatus in which the rotor includes means for urging stock downwardly to rotor vanes in a manner that minimizes the outward flow of stock until it is in the path of the defibering faces of the vanes.

Other objects and advantages of the present invention will become apparent from the following description, the accompanying drawings and the appended claims.

DESCRIPTION OF THE PREFERRED EMBODIMENTS

Figure 1:
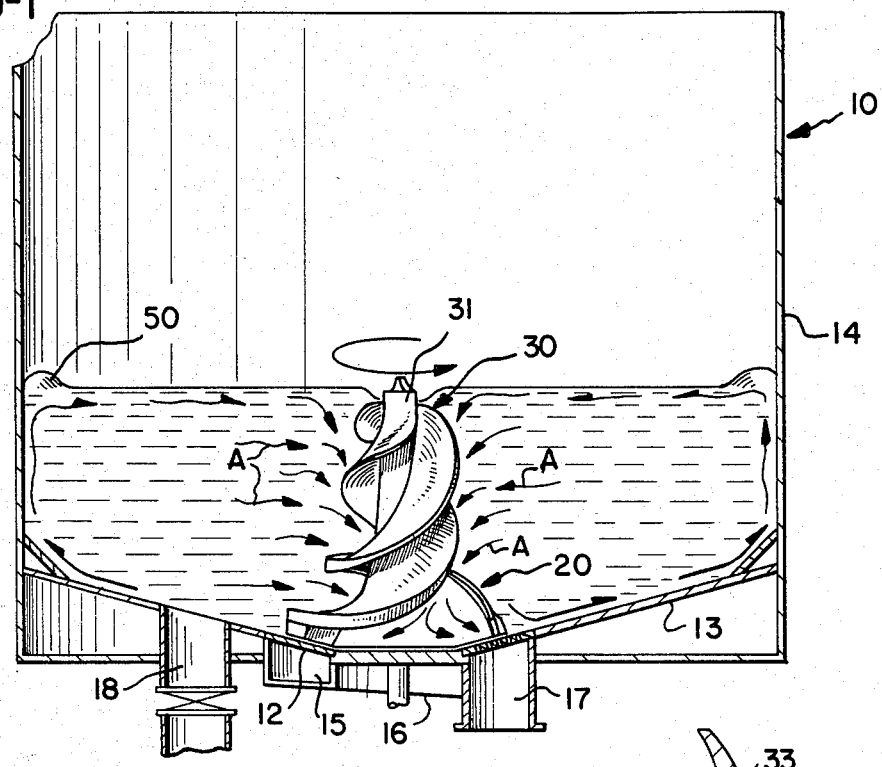
FIG. 1 is a somewhat schematic view partly in side elevation and partly in section of a pulper tub and rotor embodying the present invention.
Figure 2:
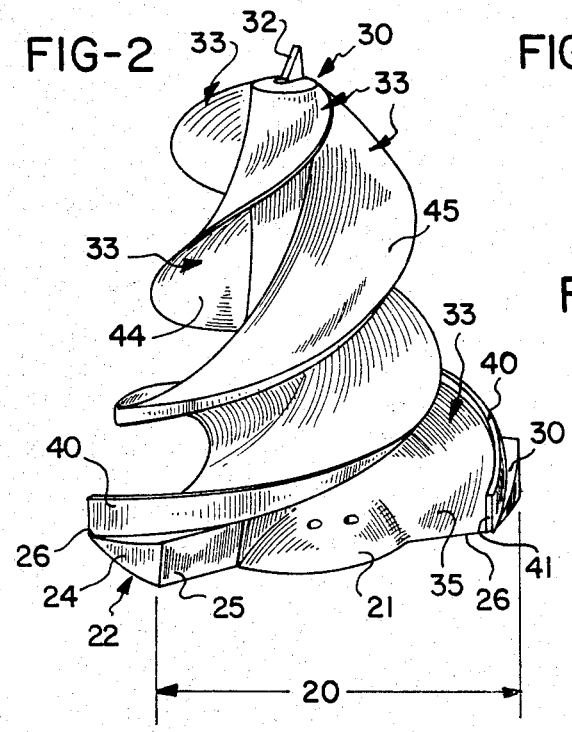
FIG. 2 is a perspective view of the rotor of FIG. 1.

As shown in FIG. 1, a preferred embodiment of the pulping apparatus of the present invention includes a pulping tub, generally designated 10, having a bottom wall comprising a plane center section 11 surrounded by a frustoconical perforated extraction plate 12 surrounded by an imperforate frustoconical portion 13 tapered at the same angle as the extraction plate 12 and a generally cylindrical side wall 14 extending upwardly therefrom.

Below the extraction plate 12 is an annular accepts chamber 15 having a tapered bottom 16 and an outlet pipe 17 having a conventional control valve (not shown). An additional outlet 18 is provided in the bottom wall 13 for reject material too large for passage through the extraction plate 12.

A rotor, generally designated 20, is mounted centrally of the bottom wall 11 for rotation about a substantially vertical axis. The rotor 20 is preferably driven by an electric motor (not shown) in a manner well-known in the art and disclosed, for example, in Couture U.S. Pat. No. 4,109,872, disclosure of which is incorporated herein by reference. The under surface of the rotor 20 is frustoconical to match the frustoconical extraction plate 12, but if the tub is provided with a flat extraction plate, as in Vokes U.S. Pat. No. 3,073,535, the bottom of the rotor should be similarly flat.

The bottom portion of the rotor 20 is of essentially the same construction disclosed in U.S. Pat. No. 4,109,872 except that it includes only three vanes rather than the six-vane rotors in that patent. As best seen in FIGS. 2, 3, 4 and 8, the rotor 20 includes a central hub portion 21 which is generally conical but preferably tapers upwardly along a curve rather than a straight line. Three vanes 22 radiate from the hub 21, each of which includes a cylindrically curved outer end face 24, and a flat defibering face 25 that is inclined forwardly and has a trailing edge 26, and a pumping face 27 that is similarly straight and forwardly inclined in vertical section but is curved as viewed in plan.

Extending upwardly from the rotor hub 21 is a feed screw 30 which includes a core section 31 forming an upwardly tapering continuation of the rotor hub 21 and provided on top with an off-center kicker vane 32 for preventing pulp from lodging on the top of the screw. The screw 30 also includes three screw flights 33 which are generally helical and interwined, and which include trailing portions 35 that merge with the upper surfaces of the respective vanes 22. The radial dimensions of the screw flights 33 increase from the top of the screw 30 toward the rotor hub 21 to match the increased diameter of the core 31 such that the width of the terminal edges of their trailing portions 35 is nearly equal to the corresponding radial dimension of the vanes 22. The screw flights 33 are so oriented relative to the vanes 22 that their terminal edges coincide with the trailing edges 26 of the vanes.

Each of the trailing portions 35 of the screw flights 33 includes a raised peripheral ridge 40 which extends upwardly from its outer edge. The ridges 40 include squared trailing ends 41, their leading ends blend into the upper surfaces of the screw flights, and their radially outer surfaces 42 form continuations of the pumping faces 27 of the rotor 20.

Figure 5:
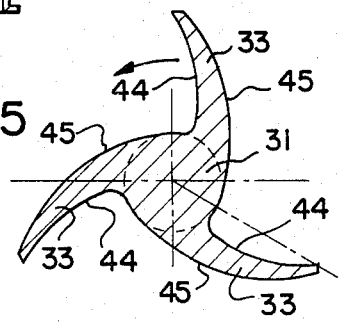
FIG. 5 is a sectional view of the rotor taken at line 5—5 in FIG. 4.
Figure 6:
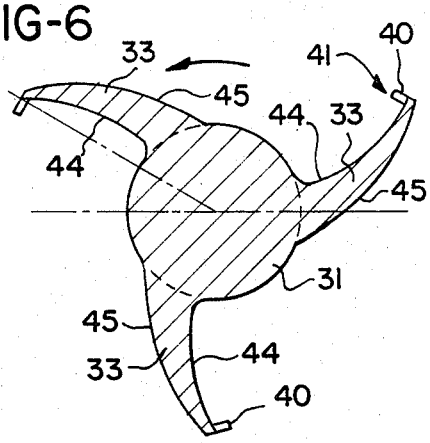
FIG. 6 is a sectional view of the rotor taken at line 6—6 in FIG. 4.
Figure 7:
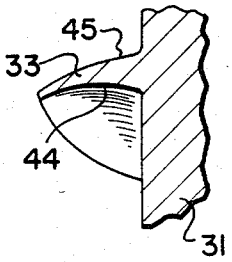
FIG. 7 is a detail of the rotor of FIG. 1 showing the concave underside of a typical screw flight.
Figure 8:
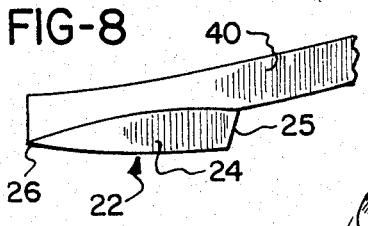
FIG. 8 is a detail view of the end of a rotor vane as indicated by the line 8—8 in FIG. 3.
Figure 4:
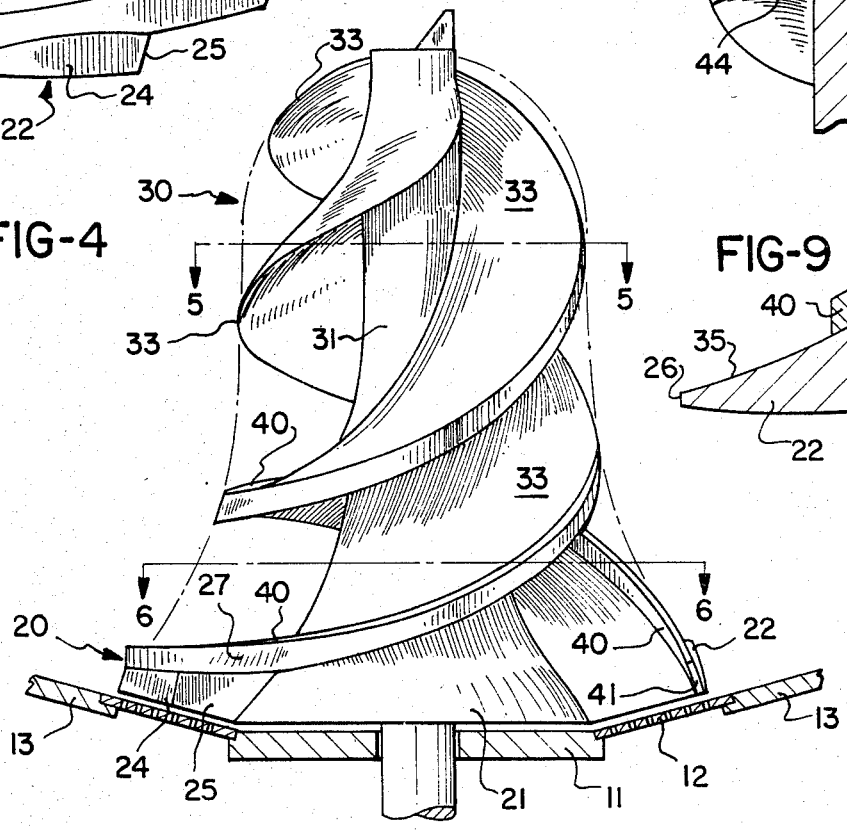
FIG. 4 is a detail of the rotor and bottom wall of the pulper of FIG. 1.
Figure 9:
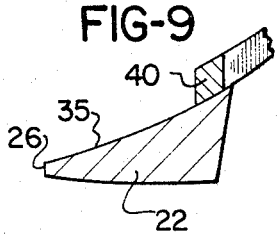
FIG. 9 is a fragmentary section on the line 9—9 in FIG. 3.

As shown in FIGS. 4, 5 and 6, the screw flights 33 are generally arcuate in section, each having an undersurface 44 which is generally concave, giving it a cup-like appearance and function. This concave shape extends the entire length of each flight 33, as is also shown in FIG. 7, which is a detail showing a side section of a typical screw flight 33. The outer or trailing side 45 of each flight 33 is smoothly convex and also of substantially greater extent, as measured along a radial section, than the leading surface 44.

As best shown in FIG. 4, the underside of the rotor 20 is shaped to conform to the contour of the bottom wall of the pulping tub 10 (FIG. 1) and extraction plate 12. The vanes 22 are positioned directly above the extraction plate 12, and the clearance between the rotor and extraction plate provides an area of mechanical shearing action. Preferably, the rotor is spaced about 1/16 inches (1.60 mm) above the extraction plate 12.

The operation of the pulping apparatus is best shown in FIG. 1. The tub 10 is first filled with a pulp stock slurry of the desired consistency to a depth which preferably approximates the height of the screw 30 but may be somewhat higher. For example, in a tub 12 feet in diameter and 10 feet in total height, tests with a rotor 42 inches in diameter and 48 inches in height, including the screw 30, show that the depth of the stock should be at least sufficient to submerge all of the rotor and screw, and may reach a level as high as to provide a total depth of 5 feet. The consistency of the pulp will vary in accordance with its nature, but by way of example, preferred results have been obtained with a waste paper furnish at 16%, while the pulp containing a substantial amount of clay or other additives making it more slippery, such as deinked stock, the consistency may be as high as 25% solids.

Figure 3:
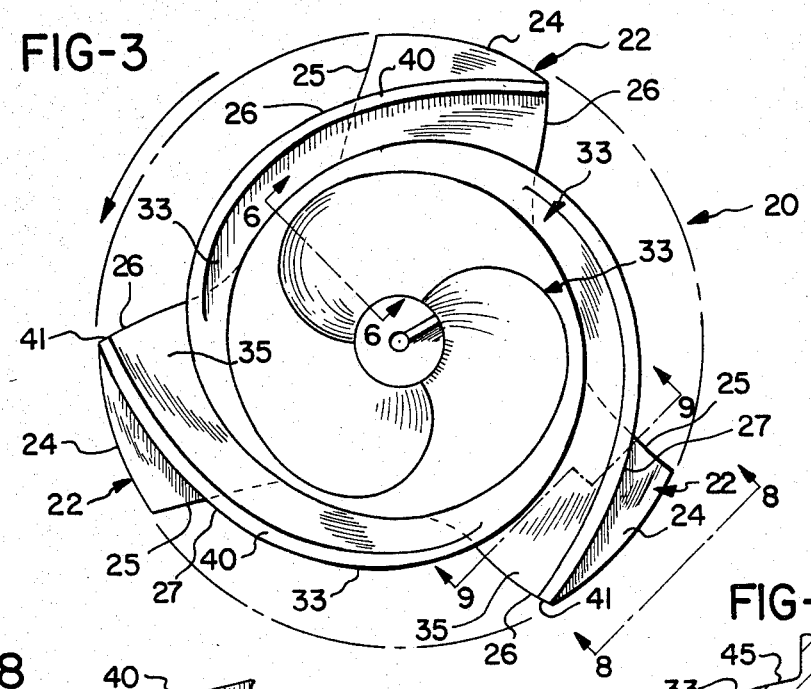
FIG. 3 is a plan view of the rotor of FIG. 1.

The rotor 20 is rotated in counterclockwise direction as it is shown in FIG. 3. This rotational movement causes the concave undersides 44 of the screw flights 33 to channel stock in their paths and thereby to draw stock inwardly in the direction of the arrows A (FIG. 1), and the helical path of the screw flights pushes the channeled stock downwardly toward the hub 21 and vanes 22. At the same time, because of the much greater surface area of the trailing face 45 of each screw flight, an air foil effect is developed in the stock such that pulp is sucked inwardly toward each of the convex trailing surfaces 45 of the screw flights and thus into the path of the following concave leading faces 44 for channeling thereby. Thus the structure and mode of operation of the screw 30 combine suction and pressure effects which draw the stock radially inwardly and then force it downwardly toward the rotor vanes 22.

The air foil action of the convex surfaces of the screw flights effectively counteracts any tendency which the pulp might otherwise have to move away from the screw before encountering the defibering faces 25 of the vanes 22. In addition, the ridges 40 along the lower portions of the outer edges of the screw flight act as the sides of troughs to retain the downwardly flowing pulp and channel it toward the path of the vanes, while the outer face of each ridge 40 also serves as an extension of the pumping face of the associated rotor vane.

As the pulp approaches the trailing portions 35 of the screw flights, the increasing radius of the screw core 31 moves the pulp radially outwardly at an accellerating rate, since it is forced to continue to travel with the rotor by the channeling action of the ridges 40. Thus by the time the pulp reaches the space in front of each vane 22, it is distributed across the entire area swept by its defibering face 25. In addition, the accellerating flow rate of the pulp in the troughs formed by the ridges 40, coupled with the fact that these troughs constantly increase in width toward the bottom of the screw, results in a Bernouli effect which applies additional suction in the spaces from which pulp is fed into those troughs.

Since the terminal edges of the screw flights 33 coincide with the trailing edges 26 of the vanes 22, the pulp flows downwardly into the area swept by the defibering faces 25 well in advance of the oncoming vanes. In addition, the pulp contacts the extraction plate 12 prior to being impelled outwardly by the vanes, and thus the interaction of the vanes with the extraction plate creates a mechanical shearing action upon the pulp in that area.

The pulp is impelled outwardly from the rotor 20 by the vane faces 25 and ridge faces 42, and travels across the bottom wall 13 to the side wall 14. The rotor preferably is rotated at a speed sufficient to drive the pulp up the side wall 14 where a small crest 50 is created, and the stock is then sucked back toward the center of the tub 10, at which time it is again drawn inwardly by the rotational movement of the screw flights 33. Thus the pulp describes a vortical flow pattern within the tub 10 such that virtually all of the fibers forming the pulp are in motion, and a hydraulic shear condition exists literally throughout the volume of the pulp within the tub.

When a given batch of pulp has been sufficiently defibered for the accepted stock to pass through the holes of the extraction plate 12, which for example may be 3/16 inch in diameter, dilution water is added in sufficient volume to reduce the consistency of the pulp slurry to 8% solids or less, and the control valve for the outlet pipe 16 is then opened. The pulper is then continued in operation until all of the good fiber has been extracted, additional water being added for the final washing stages if needed. The outlet pipe 17 is then closed, the valve or valves for the reject outlet 18 are opened, and whatever reject material has accumulated in the tub is flushed out.

Although not shown in the drawings, it is within the scope of the invention to modify the side wall 14 to promote the flow of rising stock toward the center of the tub. For example, side baffles such as those disclosed in Blakely et al. U.S. patent application Ser. No. 407,371, filed Aug. 12, 1982 and commonly assigned, may be employed. Alternately, the tub can be "cognac-glass" shaped with a side wall of a substantially cylindrical section that diminishes in diameter as it extends upwardly from the bottom plate. The inward slope of the walls, the head created by the rotor and the sucking effort of the screw 30 would then urge the rising stock toward the center of the tub.

While the forms of apparatus herein described constitute preferred embodiments of the invention, it is to be understood that the invention is not limited to these precise forms of apparatus, and that changes may be made therein without departing from the scope of the invention.

What is claimed is:

1. Apparatus for pulping high consistency paper pulp comprising:

(a) a tub having a bottom wall and a generally cylindrical side wall extending upwardly from said bottom wall;

(b) a rotor mounted centrally of said bottom wall for rotation about a vertical axis and including a base portion and a plurality of vanes extending generally radially outwardly from said base portion and having defibering faces thereon, (c) a plurality of helical screw flights extending upwardly from said base portion, each of said flights having a concave undersurface and having also a trailing portion terminating at said base portion and having a width in a radial direction substantially equal to the radial length of said vanes, (d) the height of said rotor being greater than the diameter thereof, and (e) means for rotating said rotor with said concave undersurfaces constituting the leading surfaces of said flights to cause said undersurfaces to channel high consistency pulp in their paths and push such channeled pulp downwardly to said defibering faces, whereupon said faces impel said pulp outwardly along said bottom wall and toward said side wall with minimal cavitation.

2. The apparatus of claim 1 wherein each of said trailing portions of said screw flights includes an outer peripheral ridge extending upwardly therefrom and having a height in an axial direction sufficient to prevent pulp flowing downwardly over an upper surface of said flights from flowing radially outwardly from said flight until reaching the vicinity of said defibering faces of said vanes.

3. The apparatus of claim 1 wherein the outer surface of each of said screw flights is convexly curved and of substantial greater surface area than said concave undersurface of said flight to provide an air foil effect causing pulp to be drawn inwardly and into the path of the adjacent said flight undersurface.

4. The apparatus of claim 2 wherein each of said trailing portions of said screw flights includes a terminal edge which coincides with a trailing edge of an associated one of said vanes.

5. The apparatus of claim 2 wherein said vanes are spaced above said bottom plate a distance sufficient to create mechanical shearing of stock as said rotor rotates in the presence of high consistency stock.

6. The apparatus of claim 1 wherein said tub bottom wall is frustoconical, and said vanes have similarly conical undersurfaces to enable said vanes to impel pulp upwardly along said bottom wall.

7. In apparatus for pulping high consistency paper pulp of the type including a tub with a generally horizontal bottom wall and a side wall of generally cylindrical section extending upwardly from said bottom wall and forming a pulping chamber therewith, the combination of:

(a) a rotor comprising a hub portion mounted centrally of said bottom wall for rotation about a substantially vertical axis;

(b) vane means extending generally radially outwardly from said hub and including pumping and defibering faces for impelling pulp outwardly toward said side wall;

(c) helical screw flights extending upwardly from said hub and having a concave undersurface extending the entire length thereof;

(d) means for rotating said rotor with said concave undersurfaces constituting the leading surfaces of said flights to cause said undersurfaces to draw high consistency pulp stock inwardly toward said axis and push such pulp stock downwardly to be engaged by said vane face means;

(e) the outer surface of each of said screw flights being convexly curved and of substantially greater surface area than said concave undersurface of said flight to provide an air foil effect causing pulp to be drawn inwardly and into the path of the adjacent said flight undersurface;

(f) each said flight including outer peripheral ridge means extending upwardly therefrom and having a height in an axial direction sufficient to retain pulp pushed downwardly by said flight against dispersing outwardly therefrom; and (g) the radially outer surface of each of said ridge means forming a curved pumping face.

8. The apparatus of claim 7 wherein the space between said flights has a width at the lower ends thereof substantially equal to the length of said vane means.

* * * * *